United States Patent [19]

Sluys

[11] 4,318,361

[45] Mar. 9, 1982

[54] LIGHTWEIGHT CONCRETE MARINE FLOAT AND METHOD OF CONSTRUCTING SAME

[75] Inventor: Wesley W. Sluys, Bellingham, Wash.

[73] Assignee: Builders Concrete, Inc., Bellingham, Wash.

[21] Appl. No.: 63,762

[22] Filed: Aug. 6, 1979

[51] Int. Cl.[3] ..... B63B 3/00; B63B 5/00; B63B 9/06

[52] U.S. Cl. ..... 114/263; 114/267; 114/65 A; 114/264; 114/266; 114/77 R; 264/DIG. 7; 405/219; 14/27; 521/54

[58] Field of Search ..... 114/65 A, 264, 266, 114/267, 263; 264/DIG. 7; 405/219; 14/27; 521/54, 55

[56] References Cited

U.S. PATENT DOCUMENTS

| | | | |
|---|---|---|---|
| 2,687,226 | 8/1954 | Garrett | 294/97 X |
| 2,841,301 | 7/1958 | Sherriff | 294/93 X |
| 3,000,516 | 9/1961 | Dixon | 414/226 X |
| 3,012,533 | 12/1961 | Tellefsen | 114/267 |
| 3,272,765 | 9/1966 | Sefton | 521/54 |
| 3,326,393 | 6/1967 | Jaeger | 414/226 |
| 3,580,202 | 5/1971 | Thompson | 114/266 |
| 3,659,540 | 5/1972 | Toby | 114/266 |
| 3,715,040 | 2/1973 | Polus et al. | 294/93 X |
| 4,121,868 | 10/1978 | Pierce et al. | 294/95 X |

*Primary Examiner*—Trygve M. Blix

*Assistant Examiner*—D. W. Keen

*Attorney, Agent, or Firm*—Seed, Berry, Vernon & Baynham

[57] ABSTRACT

A lightweight concrete float having a concrete shell surrounding either a hollow or buoyant foam core. The shell includes a deck surrounded by integrally formed, downwardly projecting side walls of sturdy but relatively heavy standard aggregate concrete and a bottom surrounded by integrally formed, upwardly projecting uniform or tapered side walls of lightweight but relatively weak foam aggregate concrete. Reinforcing rods are embedded along the edges of the deck, and a reinforcing mesh extends around the reinforcing rods and through the deck, side walls and bottom. The float may be formed by first pouring a layer of foam aggregate concrete into a form having a rectangular bottom surrounded by four sides. A block of buoyant foam is then placed on the bottom layer of concrete with the sides of the block spaced apart from the sides of the form. The space between the sides of the form and the sides of the block is partially filled with foam aggregate concrete. Standard aggregate concrete is then poured into the form in order to fill the remaining space between the sides of the form and the sides of the block and to cover the upper surface of the block. Vibration of the interface between the foam aggregate concrete and the standard aggregate concrete ensures firm bonding between the two concrete varieties.

18 Claims, 8 Drawing Figures

LIGHTWEIGHT CONCRETE MARINE FLOAT AND METHOD OF CONSTRUCTING SAME

BACKGROUND OF THE INVENTION

1. Field of the Invention

This invention relates to concrete marine floats and, more particularly, to a concrete marine float employing two varieties of concrete having differing characteristics.

2. Description of the Prior Art

Marine floats having a shell of standard aggregate concrete surrounding either a hollow or buoyant foam core are in common use. While these floats are generally capable of forming strong, long lasting and relatively stable marine piers, they are extremely heavy thereby making them expensive to transport to an installation site. Also, their heavy weight necessitates a relatively deep float in order to achieve the necessary freeboard so that the floats utilize a relatively large quantity of concrete and other materials thereby making them expensive to manufacture.

To alleviate the above described problems with concrete floats of standard aggregate concrete, marine floats have been manufactured of lightweight shale aggregate concrete which has almost the strength of standard aggregate concrete but is far less dense. Although these lighter floats effectively solve some of the problems associated with standard aggregate concrete, lightweight shale concrete is far more expensive and it is extremely energy intensive to produce. Furthermore, it has a greater tendency to absorb water.

An additional problem with marine floats of standard aggregate and expanded shale aggregate concrete results from the heavy weight of the concrete in combination with concrete's well known inability to withstand tensile loads. Since the standard aggregate concrete and the expanded shale aggregate concrete have a much greater density than water, gravity exerts a downward force on the bottom of the float which produces tension in the side walls of the float. The side walls are sometimes unable to withstand this tension causing the bottom to fall away from the float.

A third approach to the fabrication of concrete marine floats is the utilization of foam aggregate concrete. The manufacture and characteristics of foam aggregate concrete are fully described in Bagon et al "Marine Floating Concrete made with Polystyrene Expanded Beads, Magazine of Concrete Research, Vol. 28, No. 97, December 1976" and in U.S. Pat. Nos. 3,272,765 and 4,011,355. In this type of float the foam aggregate concrete is cast in solid blocks which are then secured to each other to form a pier. Although foam aggregate concrete is far lighter than even expanded shale concrete, it still has a density of 85% of the density of sea water thus requiring an excessively deep float to provide sufficient freeboard for pier construction. For example, a foam aggregate concrete float providing a standard 14 inch freeboard would be over 7 feet thick. The tremendous cost of this quantity of concrete plus enormous freight costs as well as the frequent lack of sufficient water depth for floats having this thickness preclude the widespread use of such floats.

An apparent solution to the above described limitation of foam aggregate concrete would be to utilize foam aggregate concrete to form a shell surrounding a hollow or buoyant foam core. However, foam aggregate concrete is much weaker than either standard aggregate concrete or lightweight shale concrete. This weakness manifests itself in an inability to withstand breaking up of the float responsive to stresses imparted by strong tidal action or vessels and in poor wearing qualities principally on deck walkways.

Thus serious problems and limitations must be resolved or at least compensated for in the construction of marine piers utilizing any of the presently available varieties of concrete marine floats.

SUMMARY OF THE INVENTION

It is an object of the invention to provide a lightweight concrete marine float which has sufficient strength to stand stresses typically imparted to marine floats by tidal action, currents and vessels.

It is another object of the invention to provide a lightweight marine float having a deck with sufficient wear-resistant qualities to provide an acceptably long useful life.

It is still another object of the invention to provide a lightweight marine float which is fabricated of relatively inexpensive concrete.

It is still another object of the invention to provide a concrete marine float which inherently places the sidewall and bottom concrete in compression rather than tension.

It is a further object of the invention to provide a method of constructing a relatively lightweight and sturdy marine float which is relatively inexpensive and which does not extensively depart from conventional manufacturing methods.

It is still further object of the invention to provide a lightweight float having a center of gravity which is spaced a relatively large distance beneath the center of buoyancy so that the float is relatively stable.

These and other objects of the invention are provided by a marine float having the shape of a parallelepiped formed by a deck of standard aggregate concrete and side walls and a bottom of foam aggregate concrete. The shell surrounds a buoyant core formed by either a void or a block of buoyant foam. The use of standard aggregate concrete for the deck provides the float with sufficient strength to withstand shocks typically imparted to it and to secure the floats to each other. The standard aggregate concrete deck also is sufficiently resistant to wear to provide a long life walking surface. The use of foam concrete aggregate for the bottom and at least part of the side walls does not detract from the strength of the float since little strength is required in these areas. Furthermore, since the side walls and bottom of the float are buoyant, the side walls and bottom of the float are maintained in compression rather than tension. The standard aggregate concrete forming the deck preferably extends downwardly along the sides of the core for a predetermined distance to form a relatively high strength rim surrounding the deck.

In order to further strengthen the float, reinforcing bars may be placed along the edges of the deck and a reinforcing mesh may extend around the bars and through the deck, side walls and bottom of the float.

In order to secure the floats to each other and to further reduce the weight of the float, a plurality of transverse reinforcing ribs are preferably integrally formed with the deck with at least some of the ribs having a tubular conduit extending therethrough to receive tie rods for connecting the floats to each other. The center of gravity of the float can be spaced farther beneath its center of buoyancy by progressively increasing the thickness of the sidewalls from top to bottom thereby improving the stability of the float.

The float is preferably constructed by pouring foam aggregate concrete into a form having the shape of a parallelepiped to cover the bottom of the form. A block of buoyant foam or a hollow structure is then placed on the bottom layer with the sides of the core spaced apart from the adjacent sidewalls of the form. Additional foam aggregate is poured into the space between the core and form to a predetermined level. The remaining space between the core and the form is filled with standard aggregate concrete and the upper surface of the core is covered with standard aggregate concrete to form the deck. The interface between the foam aggregate concrete and the standard aggregate concrete is preferably vibrated before the concrete has set to promote mixing of the two concrete varieties thereby forming a strong bond.

DETAILED DESCRIPTION OF THE INVENTION

Figure 1:
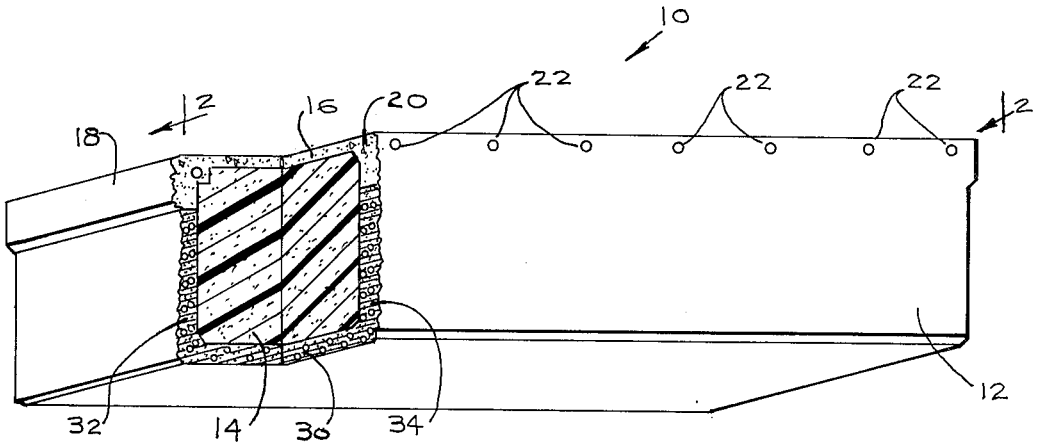
FIG. 1 is an isometric view of the concrete marine float partially broken away to illustrate its construction.

The lightweight concrete marine float 10 as illustrated in FIG. 1 includes a rigid concrete shell 12 surrounding a buoyant core of foam 14 such as polystyrene. The shell 12 is formed by a deck 16 of standard aggregate concrete surrounded by downwardly extending end walls 18 and side walls 20 integrally formed with the deck 16 by standard aggregate concrete. The upper end walls 18 preferably project outwardly farther than the lower end walls 32 and the upper end edges of the core 14 are relieved so that relatively thick reinforcing members are formed at the upper edges of the float 10. The upper side edges of the core 14 are chamfered to provide a relatively thick junction between the deck 16 and side walls 20. A plurality of spaced apart tubular conduits 22 extend through transverse reinforcing ribs (shown hereinafter) integrally formed with the deck 16. Thus the standard aggregate concrete forming the deck 16 and upper end and side walls 18, 20 respectively, provides a durable walkway as well as sufficient structural strength for the float 10.

The shell 12 also includes a bottom 30 of foam aggregate concrete surrounded by lower end and side walls 32, 34, respectively, which are integrally formed with the bottom 30 of foam aggregate concrete. Since the foam aggregate concrete forming the bottom 30 is preferably less dense than water, an upward force is exerted on the core 14 by the bottom 30. Consequently the end and side walls 32,34,62,64, and bottom 30 are maintained in a state of compression rather than tension. The strength of concrete is much greater in compression than in tension so that the relatively low density of the foam aggregate concrete results in a relatively strong shell with no tendency for the bottom 30 of the float to separate from the remainder of the float. Although a buoyant core 14 of a buoyant foam is illustrated in FIG. 1 it will be understood that other buoyant core structures may also be used. For example, the core 14 may be hollow so that the shell 12 surrounds a hollow structure or vessel.

Figure 2:
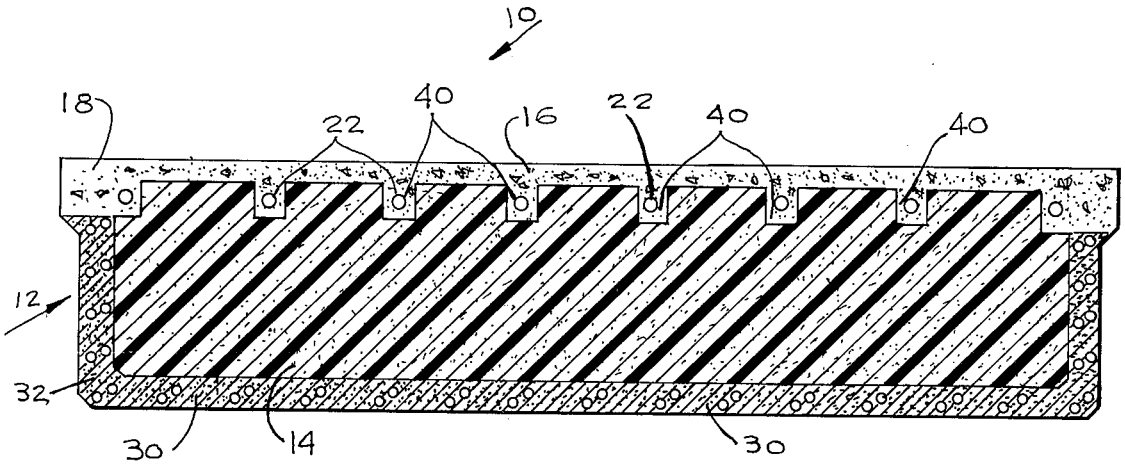
FIG. 2 is a cross-sectional view taken along the line 2—2 of FIG. 1.

The lightweight marine float 10 is illustrated in greater detail in FIG. 2. A plurality of spaced apart, downwardly projecting reinforcing ribs 40, integrally formed with the deck 16, surround the tubular conduits 22 referred to above. The tubular conduits 22 are adapted to receive rigid tie bars to which elongated wales are secured in order to fasten plurality of floats 10 to each in a conventional manner. The reinforcing ribs 40 have two purposes. First, they markedly increase the load supporting ability of the deck 16 so that the mean thickness of the deck 16 can be reduced. The float 10 thus requires less standard aggregate concrete and consequently is less expensive and lighter in weight. Secondly, the ribs 40 provide a relatively strong frame or skeleton to receive the tie rods which join the floats to each other. The tie rods are thus firmly secured to the deck 16 which is the primary structural member for the float 10. Although a conduit 22 is shown embedded in each rib 40, it will be understood that only some of the ribs 40 may contain a conduit 22.

Figure 3:
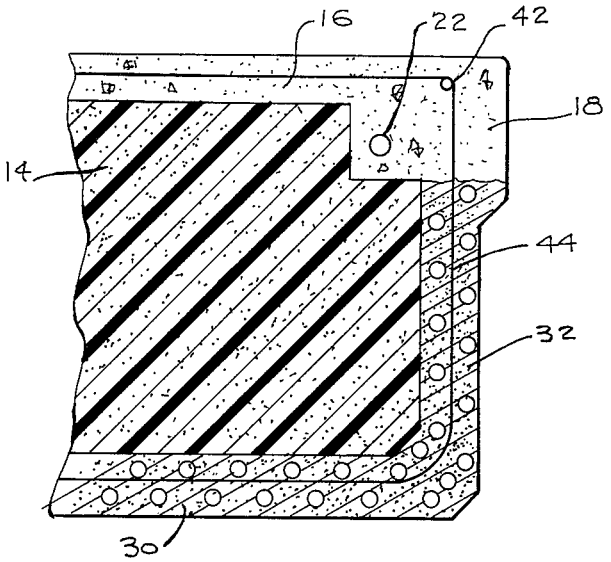
FIG. 3 is a detail view of the area indicated in FIG. 2 showing more specific aspects of the construction of the concrete marine float.

Additional reinforcing members are embedded in the shell 12 as best illustrated in FIG. 3. Reinforcing bars 42 are embedded in the standard aggregate concrete along the edges of the deck 16 and a reinforcing mesh 44 of conventional design extends around the bars 42 and through the deck 16, upper end walls 18, lower end walls 32, upper side walls 20, lower side walls 34 and the bottom 30 to strengthen the concrete, particularly in reaction to tension.

Figure 4:
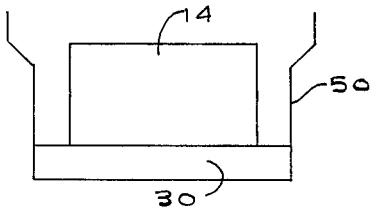
FIG. 4 is a cross-sectional view illustrating an initial fabrication stage of the float.
Figure 5:
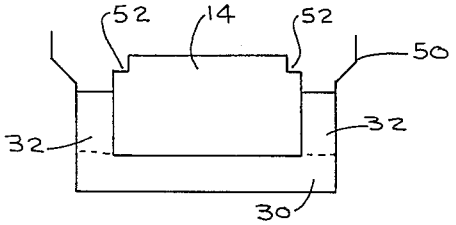
FIG. 5 is a cross-sectional view illustrating a subsequent fabricating stage of the marine float.
Figure 6:
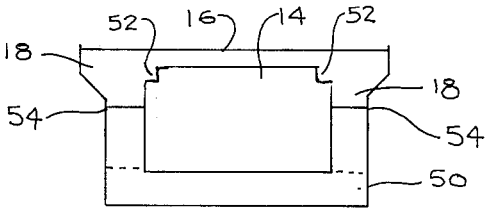
FIG. 6 is a cross-sectional view illustrating the final fabricating stage of the marine float.

The concrete floats 10, 60 are constructed according to the method illustrated in FIGS. 4–6. A form 50 generally having the shape of a parallelepiped is constructed with four side walls and a bottom. Foam aggregate concrete is initially poured into the form 50 to cover the bottom of the form 50 thereby forming the bottom 30 of the float. A buoyant core, which may be the block of buoyant foam 14 illustrated in FIGS. 1–3, is then placed on the float bottom 30 preferably before the foam aggregate concrete has hardened.

In constructing a float 60 (FIGS. 7 and 8) having tapered end and side walls 62,64, respectively, the core 14 is first tapered or chamfered inwardly toward the bottom.

Figure 7:
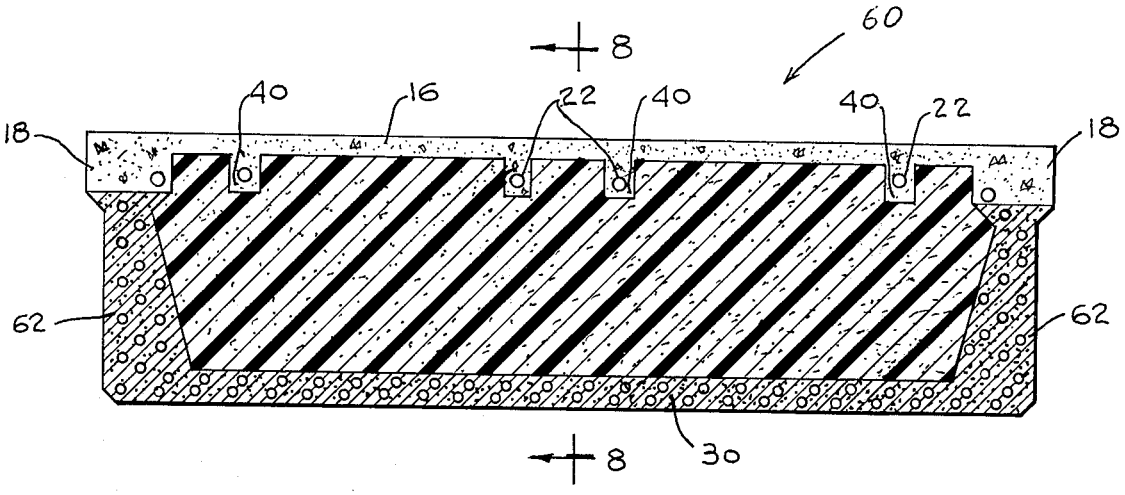
FIG. 7 is a longitudinal cross-sectional view of an alternative embodiment of the float having improved stability characteristics.
Figure 8:
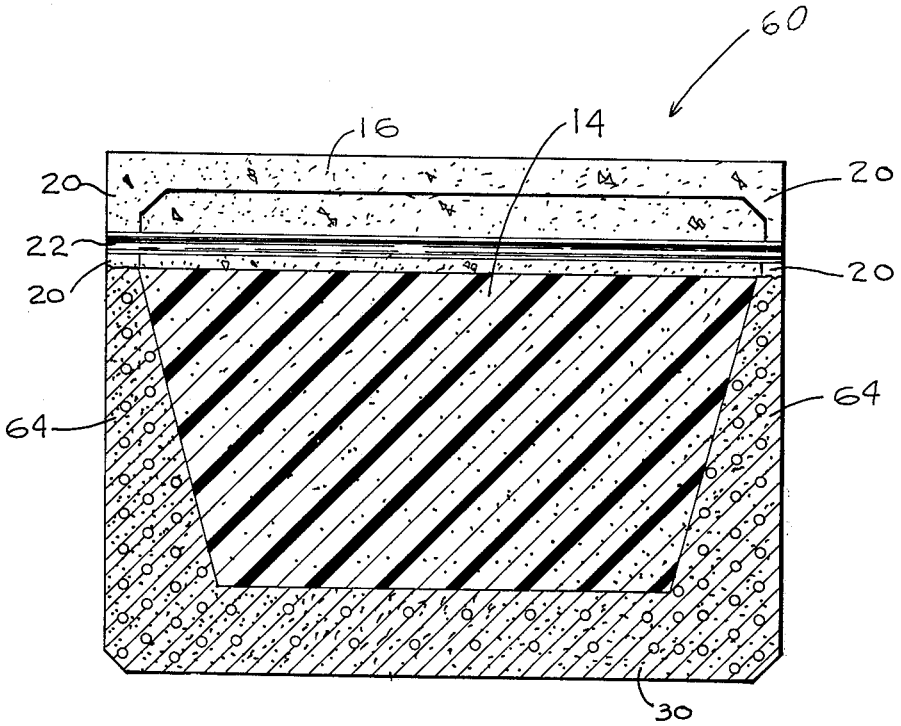
FIG. 8 is a cross-sectional view of the float of FIG. 7 taken along the line 8—8 of FIG. 7.

An alternative embodiment of the float having improved stability characteristics is illustrated in FIGS. 7 and 8. The float 60 has a deck 16, end walls 18, side walls 20, a bottom 30, a core 14 and conduits 22 embedded in ribs 40 which are substantially identical to correspondingly numbered structures of the float 10 of FIGS. 1–3. However, the float 60 has lower end walls 62 and lower side walls 64 which are tapered so that they are progressively thicker from top to bottom. The use of lighter weight foam aggregate concrete at the bottom of the float 10 of FIGS. 1–3 and heavier standard aggregate concrete at the top of the float 10 tends to raise the float's center of gravity towards its center of buoyancy thereby reducing its stability. The greater thickness of the lower end walls 62 and lower side walls 64 of the embodiment of FIGS. 7 and 8 spaces the center of gravity of the float 60 farther beneath its center of buoyancy thereby improving the stability of the float 60. The stability of the float could be improved by weighting the lower portion of the float 10 or by utilizing standard aggregate concrete for the bottom 30. However, these techniques would place the end walls 32, side walls 34 and bottom 30 under tension thereby reducing the strength of the float.

As illustrated in FIG. 5, foam aggregate concrete is then poured into the space between the core 14 and side walls of the frame 50 in order to form the lower end walls 32 and side walls 34 (FIG. 1) of the float. The upper end edges of the block 14 are then provided with rectangular cut-outs 52 and the upper side edges of the core 14 are chamfered. Alternatively, the core 14 may be chamfered and provided with the cut-outs 52 at an earlier time.

Finally, as illustrated in FIG. 6, standard aggregate concrete is poured into the form 50 to fill the remaining space between the core 14 and walls of the form 50 thereby forming the upper end walls 18 and upper side walls 20 (FIG. 1) and to cover the upper surface of the core 14 thereby forming the deck 16. In order to promote mixing of the standard aggregate concrete and the foam aggregate concrete at the interface 54 between the two types of concrete, the interface 54 is preferably vibrated before the concrete has set. This mixing creates a strong bond between the foam aggregate and standard aggregate concretes.

If the deck 16 is to be provided with reinforcing ribs 40 (FIG. 2) grooves are cut into the upper surface of the core 14 before the standard aggregate concrete is poured into the form 50 to create the deck 16. The tubular conduits 22 are placed in the grooves before the concrete is poured so that the conduits 22 are embedded in the ribs 40.

Where the reinforcing rods 42 and reinforcing mesh 44 are utilized, the rods 42 and mesh 44 are accurately positioned within the form 50 before the concrete is poured.

After the standard aggregate concrete and the foam aggregate concrete have set the resulting float is removed from the form 50 and shipped to an installation site where tie rods (not shown) are inserted through the tubular conduits 22 and secured to elongated wales extending along the upper side walls 20 of the float.

I claim:

1. A lightweight concrete marine float having the shape of a parallelepiped, comprising a generally rectangular deck plate having a substantially smooth deck surface, said deck plate being formed by standard aggregate concrete having a density greater than the density of water, said float further including side walls, end walls and a bottom plate having interconnected adjoining edges, said side walls, end walls and bottom plate being formed of a lightweight aggregate concrete having a density which is less dense than the density of water, said deck plate, side walls, end walls and bottom plate surrounding a buoyant foam core such that when said float is placed in water, the bottom plate is biased against the underside of said foam core, thereby inherently compressing the side walls and end walls of said float to maximize the strength of said float.

2. The float of claim 1 wherein the edges of said deck project downwardly along the sides and ends of said core for a predetermined distance to form a relatively high-strength rim surrounding said deck.

3. The float of claim 1 wherein said deck further includes a plurality of spaced-apart reinforcing ribs formed of standard aggregate concrete projecting downwardly from said deck and integrally formed therewith.

4. The float of claim 3 wherein an elongated cylindrical conduit extends through at least some of said reinforcing ribs to receive respective tie rods adapted to allow a plurality of said floats to be secured to each other.

5. The float of claim 1, further including a sheet of reinforcing mesh continuously extending through the deck, side walls and bottom of said float.

6. The float of claim 1 wherein the side walls and end walls of said float have a thickness which increases toward the bottom of said float, thereby improving the stability of said float.

7. A lightweight concrete marine float having the shape of a parallelepiped, comprising a rectangular deck surrounded by downwardly projecting rectangular upper side and end walls integrally formed therewith by standard aggregate concrete having a density greater than the density of water, and a rectangular bottom surrounded by upwardly projecting rectangular lower side and end walls integrally formed therewith by lightweight aggregate concrete having a density which is less than the density of water, the thickness of said upper end walls being substantially greater than the thickness of said lower end walls, thereby forming a pair of relatively thick, relatively strong reinforcing members at the end edges of said deck, said float further including a sheet of reinforcing mesh continuously extending through the deck, side walls, end walls and bottom of said float such that when said float is placed in water, the side walls and end walls are inherently placed in compression to maximize the strength of said float.

8. The float of claim 7, further including a core of buoyant foam surrounded by said deck, bottom, side walls and end walls.

9. The float of claim 7, further including a plurality of spaced-apart reinforcing ribs formed of standard aggregate concrete projecting downwardly from said deck and integrally formed therewith and an elongated cylindrical conduit extending through at least some of said reinforcing ribs to receive respective tie rods adapted to allow a plurality of said floats to be secured to each other.

10. A method of constructing a lightweight marine float, comprising:

constructing a form generally having the shape of a parallelepiped, said form having a rectangular bottom surrounded by four generally rectangular walls;

pouring a lightweight aggregate concrete into said form to create a layer covering the bottom of said form, said lightweight aggregate concrete, when cured, having a density which is less than the density of water;

placing a buoyant foam core on said bottom layer of lightweight aggregate concrete, with the sides of said core spaced apart from adjacent walls of said form;

pouring a lightweight aggregate concrete along the sides of said core to fill at least part of the space between said core and said form to a predetermined level, said lightweight aggregate concrete, when cured, having a density which is less than the density of water;

pouring a standard aggregate concrete into said form to fill any remaining space between said core and said form and to cover the upper surface of said core, said standard aggregate concrete, when cured, having a density which is greater than the density of water; and separating said form from said float after said lightweight aggregate concrete and said standard aggregate concrete have set such that when said float is placed in water, the side walls and end walls are inherently place in compression to maximize the strength of said float.

11. The method of claim 10, further including the step of vibrating the interface between said standard aggregate concrete and said lightweight aggregate concrete along the sides of said core, thereby promoting mixing of said concrete types to create a strong junction between said standard aggregate concrete and said lightweight aggregate concrete.

12. The method of claim 10, further including the step of surrounding said core with a reinforcing mesh before either said standard aggregate concrete or said lightweight aggregate concrete is poured into said form in order to strengthen said concrete and the bond between said standard and lightweight aggregate concretes.

13. The method of claim 12, further including the step of placing a reinforcing bar along each edge of said core, with said reinforcing mesh extending around and enclosing said bars.

14. The method of claim 10, further including the step of forming a plurality of spaced-apart grooves in said core and placing a tubular conduit in at least some of said grooves before said standard aggregate concrete is poured over the upper surface of said core, thereby forming a plurality of reinforcing ribs of standard aggregate concrete, some of which may later receive a tie bar therethrough.

15. The method of claim 10, further including the step of chamfering the sides of said core inwardly toward the bottom thereof so that the sides of said float are relatively thick toward the bottom thereof, thereby improving the stability of said float.

16. A lightweight concrete marine float having the shape of a parallelepiped, comprising a rectangular deck of standard aggregate concrete having a density greater than the density of water, and a rectangular bottom surrounded by upwardly projecting, rectangular side and end walls integrally formed therewith by lightweight aggregate concrete having a density which is less than the density of water, said bottom, side walls and end walls surrounding a buoyant core such that when said float is placed in water, it floats with said end walls and said side walls inherently placed in compression to maximize the strength of said float.

17. The float of claim 16, further including a core of buoyant foam surrounded by said deck, bottom, side walls and end walls.

18. The float of claim 16, further including a plurality of spaced-apart reinforcing ribs formed of standard aggregate concrete projecting downwardly from said deck and integrally formed therewith and an elongated cylindrical conduit extending through at least some of said reinforcing ribs to receive respective tie rods adapted to allow a plurality of said floats to be secured to each other.

* * * * *